United States Patent [19]

Houser

[11] Patent Number: 4,958,578

[45] Date of Patent: Sep. 25, 1990

[54] DRUMMED WASTE INCINERATION

[75] Inventor: Clarence G. Houser, Bartlesville, Okla.

[73] Assignee: Phillips Petroleum Company, Bartlesville, Okla.

[21] Appl. No.: 238,502

[22] Filed: Aug. 30, 1988

Related U.S. Application Data

[63] Continuation of Ser. No. 8,975, Jan. 30, 1987, abandoned.

[51] Int. Cl.[5] ..... A47J 36/00; A47J 36/24

[52] U.S. Cl. ..... 110/246; 110/212; 110/215; 110/216; 110/219; 110/222; 110/235; 110/238; 110/346

[58] Field of Search ..... 110/218, 219, 222, 235, 110/203, 210, 212–216, 246, 255, 257–259, 264–265, 185, 193, 344–346; 55/73, 94

[56] References Cited

U.S. PATENT DOCUMENTS

| | | | |
|---|---|---|---|
| 3,513,788 | 5/1970 | Ostrin | 110/255 X |
| 3,589,313 | 6/1971 | Smith et al. . | |
| 3,596,614 | 8/1971 | Smith et al. . | |
| 3,725,538 | 4/1973 | Brewer . | |
| 3,733,271 | 5/1973 | Olsen | 210/63 |
| 3,741,890 | 6/1973 | Smith et al. . | |
| 3,848,548 | 4/1974 | Bolejack, Jr. et al. | 110/222 X |
| 3,859,933 | 1/1975 | Von Klenck | 110/216 X |
| 3,884,162 | 5/1975 | Schuster | 110/222 |
| 3,954,381 | 5/1976 | Marecaux | 110/215 X |
| 3,996,862 | 12/1976 | Besik et al. | 110/219 X |
| 4,262,610 | 9/1981 | Hein et al. | 110/216 X |
| 4,269,806 | 5/1981 | Yaguchi et al. | 110/215 X |
| 4,395,958 | 8/1983 | Caffyn et al. | 110/246 |
| 4,424,755 | 1/1984 | Caffyn et al. | 110/246 |
| 4,437,418 | 3/1984 | Guillamme et al. | 110/246 |
| 4,531,463 | 7/1985 | Kratz et al. | 110/219 X |
| 4,785,745 | 11/1988 | Hahni et al. | 110/238 X |

FOREIGN PATENT DOCUMENTS

| | | |
|---|---|---|
| 265495 | 10/1968 | Austria . |
| 2364557 | 12/1973 | Fed. Rep. of Germany . |
| 2808770 | 3/1978 | Fed. Rep. of Germany . |
| WO87/02119 | 4/1987 | PCT Int'l Appl. . |
| 73/9697 | 12/1973 | South Africa . |
| 2015706 | 9/1979 | United Kingdom . |

OTHER PUBLICATIONS

"Flue Gras Desulfuarization", Joy Manufacturing, Sep. 1973, pp. 1–4.

Health Risk Assessment of Hazardous Waste Incinerator Stocck Emission; 1985.

*Primary Examiner*—Edward G. Favors

*Attorney, Agent, or Firm*—George E. Bogatie

[57] ABSTRACT

A method and apparatus for the incineration of waste materials contained within metal containers is disclosed wherein the metal containers containing the waste materials are fed through a shredder to form a mixture of waste materials and metal shreds. This mixture is then fed, in a controlled manner, to a primary combustion chamber wherein the waste materials and metal shreds are incincerated to produce ash, deconiannated metal sheds and combustion gases.

49 Claims, 2 Drawing Sheets

DRUMMED WASTE INCINERATION

This application is a continuation of application Ser. No. 008,975, filed Jan. 30, 1987 now abandoned.

This invention relates to incineration systems. In particular, this invention relates to incineration systems wherein waste material contained within metal containers is processed. More particularly, this invention relates to a method and apparatus for feeding metal containers containing waste material to an incineration system.

Due to an increase in environmental awareness and a decrease in available sites for land-fill operations, incineration systems are playing an increasing role in the field of waste management. The use of incineration systems is especially preferred In the disposal of various hazardous wastes. Such wastes are typically transported and stored in metal containers that, in the past, have presented a disposal problem of their own once the hazardous wastes have been removed. The metal containers are contaminated by the hazardous waste they have carried and thus can not be reused without first undergoing an expensive and bothersome decontamination process. Efforts to dispose of the metal containers also present difficulties. Due to their contaminated status, the metal containers must be disposed of in accordance with various government regulations concerning hazardous waste. Although incineration is an acceptable means of disposal for the contaminated metal containers, prior efforts to dispose of the containers in this manner have not met with much success.

Attempting to place metal containers filled with combustible waste into an incinerator system results in a rapid temperature build-up that overloads the incinerator by exceeding the incinerator's maximum rated BTU output. Efforts to dispose of these metal containers by emptying the metal containers first and then incinerating the empty containers have at least two undesirable characteristics. The first is that the waste material often has to be transferred from the container by hand, thus creating a process that is labor-intensive and hazardous for waste disposal personnel. Secondly, burning empty metal containers to remove all of the hazardous constituents contained therein requires long residence times and high temperatures, thus effecting an inefficient use of the incinerator system, while still leaving bulky constituents within the incinerator ash for disposal by the operator.

Many handlers of hazardous waste have solved the problems created by the use of metal containers by transporting and storing their waste in fiber drums, which may be incinerated along with the wastes contained within them. Depending upon the type of waste to be transported and stored, however, such fiber drums may be undesirable.

Thus, it is an object of this invention to provide a method and apparatus for the incineration of waste materials contained within metal containers, wherein the waste materials are processed in a safe, efficient manner and the metal containers are incinerated with the waste materials so as not to create a further disposal problem.

In accordance with the present invention, metal containers containing waste materials are fed through a shredder to form a mixture of waste materials and metal shreds. This mixture is then fed, in a controlled manner, to a primary combustion chamber wherein the waste materials are incinerated to produce ash and combustion gases. The combustion gases are then processed through particulate removal and acid absorbtion systems while the ash, which contains the decontaminated metal shreds, is withdrawn Into a storage drum.

Other objects and advantages of the invention will be apparent from the foregoing brief description of the invention and the appended claims as well as the detailed description of the invention which follows.

The present invention involves a method and apparatus wherein metal containers containing waste materials are shredded to form a mixture of waste materials and metal shreds. The shredding device used to shred the metal containers is connected via a suitable feeding apparatus to a primary combustion chamber in which the mixture of waste materials and metal shreds is incinerated.

The shredding device used in the present invention may be any apparatus that is capable of reducing metal containers, such as steel drums, to metal shreds that are of a size that may be processed by the chosen feeding apparatus and primary combustion chamber. A shredding device that is presently preferred is one possessing two counter-rotating cutters, which are equipped with small hooks, that grab and shear metal containers into metal strips.

The feeding apparatus used in the present invention may be any apparatus that is capable of feeding the mixture of metal shreds and waste materials to the primary combustion chamber in a controlled, uniform manner. As will be further discussed hereinafter, feeding the mixture to the primary combustion chamber in this manner produces a more consistent and efficient incineration within the combustion chamber. This prevents the problem of overloading the combustion chamber that arises when whole metal containers filled with waste materials are placed within the combustion chamber.

The primary combustion chamber used in the present invention may be any apparatus wherein waste materials may be incinerated at any suitable incineration temperature, preferably at an incineration temperature in the range of about 1200° F. to about 1800° F. As will be further discussed hereinafter, a rotary kiln is presently preferred.

Figure 2:
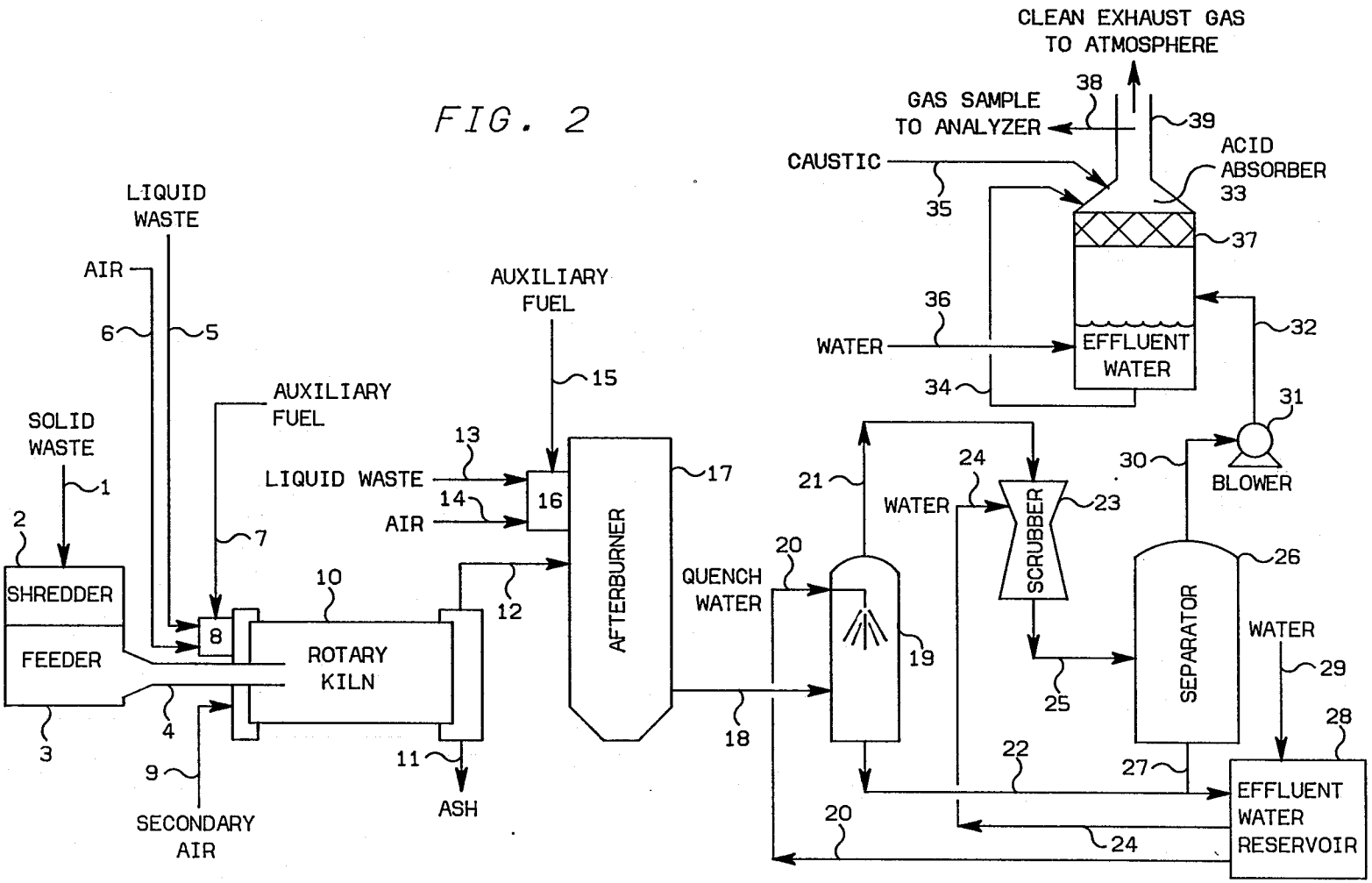
FIG. 2 is a schematic illustration of an incineration system embodying the present invention.

Turning now to the drawings and the preferred embodiment of the present invention, FIG. 2 illustrates an incineration system that generally comprises a shredder 2, which receives the metal containers containing waste materials, a feeder 3 and a primary combustion chamber 10. The primary combustion chamber 10 is equipped with a burner 8 that ignites the combustible waste material and adds heat to the primary combustion chamber as may be needed to maintain the desired temperature within the chamber. The ash from the primary combustion chamber is withdrawn 11 while the combustion gases produced in the incineration process flow into the secondary combustion chamber 17, or afterburner, which is also equipped with a burner 16 for temperature control. Hot gases containing entrained ash and particulates flow from the secondary combustion chamber to a quench tower 19 where they are contacted with quench water 20 for the purpose of lowering the temperature of the gases and removing a portion of the ash and particulates. The water-saturated gases produced within the quench tower 19 are then introduced into a venturi scrubber 23 for further removal of particulate matter. A mixture of water droplets and saturated gases is then passed into a separator 26 wherein the water droplets are separated from the saturated gases. The water is withdrawn 27 to an effluent water reservoir 28 while the saturated gases are withdrawn via an induced draft fan 31 to the acid absorber tower 33. The saturated gases are treated within the acid absorber tower 33 and then released to the atmosphere. The gases being released into the atmosphere are sampled for analysis 38 by a probe which is placed within the stack 39 of the acid absorber tower 33.

Figure 1:
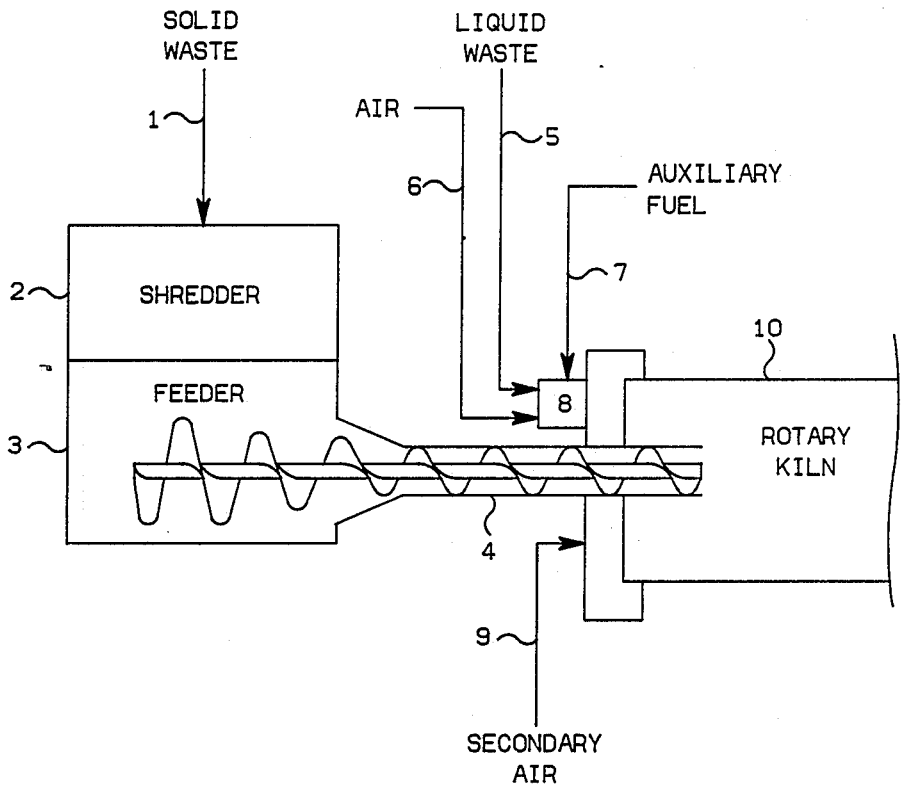
FIG. 1 illustrates a preferred embodiment of the present invention.

Turning now to FIG. 1, and a more detailed description of the invention, metal containers containing waste materials are fed to the shredder 2 via a conveyor system 1, which comprises a conveyor belt that has been adapted to carry steel drums to the mouth of the shredder 2. The shredder 2 is a rotary shear-type shredder (manufactured by Shredding Systems, Inc., Wilsonville, Oregon) comprising two counter-rotating cutters, which are equipped with small hooks, that grab and shear metal containers into metal strips. The shredder 2 produces a mixture of waste materials and metal shreds, wherein the metal shreds are typically about 12 inches in length and about 1.5 inches in width, which is gravity fed into the hopper portion of the feeder 3. The waste materials contained within the metal containers may comprise solid waste, semi-solid waste, sludge or liquid waste. The primary combustion chamber 10 operates most efficiently, however, when the wastes being fed into it are fairly uniform in size and density. Therefore, to insure a more homogeneous mixture of waste materials and metal shreds, a small amount of water or oil is normally maintained in the bottom of the feeder hopper.

The feeder 3 consists of a hopper and a compaction tube 4 which passes into the primary combustion chamber 10. The compaction tube 4 is equipped with a rotating auger that is used to feed the waste material mixture into the primary combustion chamber 10. The auger is positioned within the compaction tube 4 in such a manner as to create a fairly dense plug of waste material within the compaction tube 4. This plug effectively creates a seal within the compaction tube 4 that prevents any excess air from entering the combustion chamber 10 through the feeder 3, thereby removing the need for any mechanical sealing device at the discharge end of the compaction tube 4. The entrance end of the compaction tube 4 is narrowed in the direction of flow from the larger opening in the hopper 3 to help prevent plugging of the auger feed at the compaction tube's entrance. The auger is driven by a variable speed motor that is controlled by an external control system (not shown). The motor driving the auger feed is also connected to a kill switch that is activated in the event the temperature in the primary combustion chamber 10 drops below a predetermined operating temperature.

The primary combustion chamber 10 is preferably a rotary kiln, comprising a steel cylinder lined with refractory material, that is preferably maintained at a temperature in the range of about 1200° F. to about 1800° F. The primary combustion chamber 10 is supported for axial rotation on a plurality of trunnions which engage annular bands connected to the periphery of the cylinder. The steel cylinder is intimately contacted on its entrance end with a firing hood and on its discharge end with a discharge duct, both of which serve to seal the ends of the cylindrical kiln and thereby define the primary combustion chamber 10. Preferably, the primary combustion chamber 10 is aligned so that the chamber's axis of rotation is slightly declined from horizontal (about 3 degrees) in the direction of flow. Aligning the primary combustion chamber 10 in this manner and employing a rotary kiln greatly assists the movement of waste material and ash through the primary combustion chamber 10.

The preferred primary combustion chamber 10 is driven about its axis of rotation by a variable speed motor connected to a gear system (not shown). The rate of rotation, which is usually in the range of about 0.2 rpm to 2.0 rpm, may be varied as desired to control the retention time of the waste materials within the combustion chamber. The rotary action of the primary combustion chamber 10 continuously exposes new surfaces of waste materials to combustion materials and air as the burning waste travels down the length of the primary combustion chamber. The constant agitation of the burning materials and the ability to control the retention time within the combustion chamber results in a more efficient and complete incineration.

A burner 8, which is fastened to the firing hood on the entrance end of the primary combustion chamber, is used to ignite the combustible waste material and to add heat, as required, to maintain the desired temperature within the primary combustion chamber 10. A balanced mixture of air 6 and auxiliary fuel 7 is fed to the burner 8 to fuel the combustion. Liquid waste 5 may also be fed to the burner 8 if desired. The auxiliary fuel 7 supplied to the burner 8 may he either natural gas or fuel oil. A secondary air source is provided via conduit 9 to the primary combustion chamber 10 in order that the oxygen requirements of the waste material mixture being fed into the chamber via the compaction tube 4 may be met.

Looking now to FIG. 2, the ash 11 produced in the incineration process, along with various unburned materials, is withdrawn from the discharge end of the primary combustion chamber 10. Among the various unburned materials contained within the ash are the (now, decontaminated) metal shreds that were produced by shredding the metal container. After the ash and unburned materials have been tested for contaminants, the metal shreds may be separated from the rest of the ash and sold as scrap metal. The rest of the ash, which is no longer hazardous, may be collected and disposed of in a more conventional manner, such as land-fill.

The combustion gases from the primary combustion chamber 10 flow through high temperature ducts 12, comprising steel shells lined with refractory material, into the secondary combustion chamber 17, or afterburner. The secondary combustion chamber 17 is generally vertically aligned and preferably comprises a steel cylinder, lined with refractory material, that is capped on its upper end while having a generally conical bottom for capturing any ash that might be produced therein. Any combustible materials that might have escaped from the primary combustion chamber 10 are incinerated within the secondary combustion chamber 17, which is preferably maintained at a temperature in the range of about 1900° F. to about 2400° F. Maintaining the desired temperature in the secondary combustion chamber is accomplished through the use of a burner 16 in the same manner as prevIously described with regard to the primary combustion chamber 10. In order to insure complete combustion of all waste materials, the temperature, oxygen level and residence time within the secondary combustion chamber 17 are carefully monitored and controlled.

To assist in the complete combustion of all waste materials, the combustion gases from the primary combustion chamber 10 are fed into the secondary combustion chamber 17 in a tangential manner which creates a cyclonic effect among the gases. The cyclonic action among the gases causes centrigugal separation of particulate matter and assures a more thorough mixing of the air and gases which results in a more efficient combustion. The cyclonic path of the gases through the secondary combustion chamber 17 also increases the retention time of the gases within the combustion chamber which results in even greater efficiency within the combustion process.

Hot gases containing entrained ash and particulates, but no combustible components, flow from the secondary combustion chamber 17 through high temperature ducts 18 into a quench tower 19. In the quench tower 19, the hot gases are counter-currently contacted with quench water, supplied via conduit 20, for the purpose of lowering the temperature of the gases and for removing a portion of the ash and particulates that are entrained within the hot gases. Hot effluent quench water containing ash and particulates is then withdrawn via conduit 22 from the quench tower 19 and transported to an effluent water reservoir 28 which is eguipped with a fresh water make-up system 29.

Saturated gases, still containing entrained ash and particulates, are withdrawn from the quench tower 19 through fiberglass reinforced piping 21 and fed to a venturi scrubber 23, which is equipped with a recycle water supply 24 from the effluent water reservoir 28. Here, the entrained ash and particulates are separated from the saturated gases by the intimate contact of solids and water within the venturi scrubber. The effluent water and the saturated gases are then passed to a separator tower 26 where the water, containing the ash and particulates, is withdrawn via conduit 27 to the effluent water reservoir 28 and recycled. An effluent stream (not shown) is then withdrawn from the effluent water reservoir 28 for the purpose of removing the captured solids.

The saturated gases are withdrawn from the separator tower 26 and fed into the acid absorber column 33 by the induced draft fan 31. The induced draft fan 31 is used to maintain a negative pressure throughout the entire incineration system, thereby providing the means for transporting the various gases through the incineration system and, additionally, insuring that no undesirable gases escape into the atmosphere through a leak in the incineration system. Once the saturated gases reach the induced draft fan 31, however, the fan's function reverses as the fan creates a positive pressure and pushes the gases through the acid absorber tower 26 and out into the atmosphere.

In the event the waste materials contained within the metal containers were halogenated, the various gases produced within the incineration system would contain dilute acids. Within the acid absorber tower 33, the saturated gases are counter-currently contacted with a mixure of caustic from conduit 35 and water from conduit 34 which serves to neutralize any acid that might be contained within the saturated gases. The saturated gases and caustic/water mixture are contacted over a packed bed of berl saddles 37 to assist in the deacidification of the acidic gases. Once the acids have been removed from the saturated gases, the deacidified saturated gases are then passed through the acid absorber tower's stack 39 and into the atmosphere. A probe 38 located within the stack 39 samples the deacidified saturated gases prior to their release into the atmosphere. These samples are then analyzed to determine the final contents of oxygen, nitrogen oxide, sulfur dioxide, carbon dioxide and carbon monoxide within the deacidified saturated gases.

The salt water that is Produced in the reaction of the water/caustic mixture and the acidic gases is collected in the bottom of the acid absorber tower 33. The absorber tower 33 is equipped with a fresh water make-up via conduit 36 in order to maintain a salt concentration of about 1.0 weight-% in the recycle water reserve that is located in the bottom of the absorber tower 33. Water is withdrawn via conduit 34 from the recycle water reserve and mixed with added caustic from conduit 35 to form the caustic/water mixture. The amount of caustic from conduit 35 added to the recycled water is that amount necessary to maintain a pH of about 7 in the caustic/water mixture. The caustic/water mixture is then fed to the top of the acid absorber tower 33 where it is contacted with the packed bed of berl saddles 37. An effluent stream (not shown) is withdrawn from the recycle water reserve, for the purpose of removing excess salt, and disposed of.

The external controls that have been occasionally mentioned herein are not a part of the present invention and thus are not discussed in great detail. The external controls consist of a number of sensors and accompanying switches that effectuate the incineration process in an independent and efficient manner. The following items are examples of the external control system and how it operates to create a more efficient and independent incineration system. The control system will automatically shut down the auger feed if the temperature within the primary combustion chamber 10 falls below a specified minimum operating temperature. Likewise, the liquid waste material feeding systems 5 and 13 will be shut down by the control system if the outlet temperature of the secondary combustion chamber 17 drops below a predetermined temperature or if the flow rate of the caustic/water recycle via conduits 34 and 35 to the acid absorber tower 33 drops below a predetermined set point. If the control system's sensors indicate an excessive temperature at the quench tower 19 cutlet or an insufficient oxygen content or residence time within the secondary combustion chamber 17, it will shut down all feeding systems to the incinerator. Similarly, the oxygen levels in the two combustion chambers are closely monitored and the appropriate air supply conduits 9 and 14 are opened or restricted accordingly. Finally, the burners 8 and 16 attached to the two combustion chambers are activated or shut-off according to the respective temperatures within the two combustion chambers as monitored by the external control system.

Although the present invention has been described in terms of a preferred embodiment, reasonable variations and modifications are possible by those skilled in the art within the scope of the described invention and the appended claims.

That which is claimed is:

1. Apparatus for the disposal of waste material kept within metal container, said apparatus comprising:

a shredder for the metal container;

first conveyor means for introducing the metal container, holding the waste material, into said shredder;

means for producing a mixture of waste material and metal shreds;

a primary combustion chamber for the mixture of waste material and metal shreds;

second conveyor means for feeding said mixture of waste material and metal shreds from said shredder into said primary combustion chamber;

means for burning said mixture of waste material and metal shreds in said primary combustion chamber wherein ash, decontaminated metal shreds, and primary combustion gases containing combustible residue material, are produced in said primary combustion chamber;

a secondary combustion chamber for the primary combustion gases;

first conduit means, in fluid flow communication between said primary combustion chamber and said secondary combustion chamber, for introducing the primary combustion gases into said secondary combustion chamber, said first conduit means defining a flow path from said primary combustion chamber to said secondary combustion chamber;

means for withdrawing ash and decontaminated metal shreds from said primary combustion chamber;

means for burning combustible residue, contained in the primary combustion gases, in said secondary combustion chamber, wherein hot secondary combustion gases containing entrained ash and particulates are produced in said secondary combustion chamber; and means for introducing liquid waste material into said secondary combustion chamber.

2. An apparatus in accordance with claim 1 wherein said shredder is a rotary shear-type shredder.

3. An apparatus in accordance with claim 1 wherein said apparatus further comprises:

burner means for igniting the contents within said primary combustion chamber; and, means for supplying air and auxiliary fuel to said burner means.

4. An apparatus in accordance with claim 1 wherein said apparatus further comprises means for introducing liquid waste materials into said primary combustion chamber.

5. An apparatus in accordance with claim 1 wherein said primary combustion chamber is a rotary kiln.

6. An apparatus in accordance with claim 5 wherein said apparatus further comprises means supporting said rotary kiln for rotation about a horizontally declined axis of rotation.

7. An apparatus in accordance with claim 6 wherein said apparatus further comprises driving means for rotating said rotary kiln about said horizontally declined axis of rotation.

8. An apparatus in accordance with claim 1 wherein said secondary conveyor means for feeding the mixture from said shredder into said primary combustion chamber comprises a hopper and a compaction tube, wherein said compaction tube is equipped with means for transporting the mixture of waste material and metal shreds from said hopper to said combustion chamber.

9. An apparatus in accordance with claim 8 wherein said means for transporting said mixture comprises an auger

10. An apparatus in accordance with claim 9 wherein said auger is positioned within said compaction tube in a manner such that said mixture contacts the inner walls of said compaction tube while being transported to the combustion chamber, thereby forming a seal along at least a portion of said compaction tube.

11. An apparatus in accordance with claim 1 wherein said apparatus further comprises:

burner means for igniting the contents within said secondary combustion chamber; and, means for supplying air and auxiliary fuel to said burner means.

12. Apparatus in accordance with claim 11 further comprising:

a quench tower for contacting hot secondary combustion gases with water, thereby producing saturated gases and effluent water; and second conduit means in fluid flow communication between said secondary combustion chamber and said quench tower, for defining a flow path for hot secondary combustion gases from said secondary combustion chamber to said quench tower.

13. Apparatus in accordance with claim 12 wherein said apparatus further comprises:

scrubber means for removing ash and particulates from saturated gases, thereby producing effluent water containing ash and particulates and saturated gasses;

third conduit means in fluid flow communication between said quench tower and said scrubber means, for defining a flow path for saturated gases from said quench tower to said scrubbing means;

separator means for separating saturated gases from water containing ash and particulates;

fourth conduit means in fluid flow communication between said scrubber means and said separator means, for defining a flow path for effluent water containing ash and particulates and saturated gases from said scrubber means to said separator means;

an effluent water reservoir;

fifth conduit means in fluid flow communication between said separator means and said quench tower and said effluent water reservoir, for defining a flow path for the effluent water from said separator means and said quench tower to said effluent water reservoir;

means for introducing fresh water to said effluent water reservoir; and, sixth conduit means in fluid flow communication between said effluent water reservoir and said quench tower and said scrubber means, for defining a flow path for recycle water from said effluent water reservoir to said quench tower and said scrubber means.

14. An apparatus in accordance with claim 13 wherein said scrubber means comprises a venturi scrubber.

15. An apparatus in accordance with claim 13 wherein said separator means comprises a separator tower.

16. An apparatus in accordance with claim 13 wherein said apparatus further comprises:

an acid absorber column, said column having a stack which is open on end to the atmosphere such that deacidified gas may pass from the column into the atmosphere;

means for introducing water and caustic to said acid absorber column;

an induced draft fan, wherein said induced draft fan is located between said scrubber means and said acid absorber tower;

seventh conduit means in fluid flow communication between said separator means and said induced draft fan and between said induced draft fan and said acid absorber column, for defining a flow path for saturated gases from said separator means, through said induced draft fan, into said acid absorber column;

a gas analyzer; and, eighth conduit means in fluid flow communication between said gas analyzer and said acid absorber column, for defining a flow path for deacidified gas from said acid absorber column to said gas analyzer.

17. Apparatus in accordance with claim 1 wherein said apparatus further comprises:

a quench tower for contacting said hot gases with water, thereby producing saturated gases and effluent water;

second conduit means in fluid flow communication between said secondary combustion chamber and said quench tower, for defining a flow path for hot secondary combustion gases from said secondary combustion chamber to said quench tower;

scrubber means for removing ash and particulates from gases, thereby producing effluent water containing ash and particulates and saturated gases;

third conduit means in fluid flow communication between said quench tower and said scrubber means, for defining a flow path for saturated gases from said quench tower to said scrubbing means;

separator means for separating saturated gases from water containing ash and particulates;

fourth conduit means in fluid flow communication between said scrubber means and said separator means, for defining a flow path for water containing ash and particulates and saturated gasses from said scrubber means to said separator means;

an effluent water reservoir;

fifth conduit means in fluid flow communication between said separator means and said quench tower and said effluent water reservoir, for defining a flow path for the effluent water from said separator means and said quench tower to said effluent water reservoir;

means for introducing fresh water to said effluent water reservoir;

sixth conduit means in fluid flow communication between said effluent water reservoir and said quench tower and said scrubber means, for defining a flow path for recycle water from said effluent water reservoir to said quench tower and said scrubber means;

and acid absorber column, said column having a stack which is open on one end to the atmosphere such that deacidified gas may pass from the column, through the stack, into the atmosphere;

means for introducing water and caustic to said acid absorber column;

an induced draft fan, wherein said induced draft fan is located between said scrubber means and said acid absorber tower;

seventh conduit means in fluid flow communication between said separator means and said induced draft fan and between said induced draft fan and said acid absorber column, for defining a flow path for saturated gases from said separator means, through said induced draft fan, and into said absorber column;

a gas analyzer; and, eighth conduit means in fluid flow communication between said gas analyzer and said acid absorber column, for defining a flow path for deacidified gas from said acid absorber column to said gas analyzer.

18. An apparatus in accordance with claim 17 wherein said apparatus further comprises:

burner means for igniting the contents within said secondary combustion chamber; and, means for supplying air and auxiliary fuel to said burner means.

19. An apparatus in accordance with claim 17 wherein said scrubber means comprises a venturi scrubber.

20. An apparatus in accordance with claim 17 wherein said separator means comprises a separator tower.

21. A method for disposing of waster material kept in a metal container, said method comprising the steps of:

feeding the metal container holding the waste material into a shredder;

producing a mixture of waste material and metal shreds;

transporting the mixture of waste material and metal shreds to a primary combustion chamber;

burning said mixture of waste material and metal shreds in said primary combustion chamber, wherein ash, decontaminated metal shreds, and primary combustion gases containing combustible residue material, are produced in said primary combustion chamber;

withdrawing ash and decontaminated metal shreds from said primary combustion chamber;

withdrawing the primary combustion gases from said primary combustion chamber;

introducing the primary combustion gases into a secondary combustion chamber;

burning the combustible residue, contained in the primary combustion gases, in said secondary combustion chamber, wherein hot secondary combustion gases containing entrained ash and particulates are produced in said secondary combustion chamber; and introducing liquid waste material into said secondary combustion chamber.

22. A method in accordance with claim 21 further comprising the step of introducing liquid waste materials into said primary combustion chamber.

23. A method in accordance with claim 21 wherein said shredder is a rotary shear-type shredder.

24. A method in accordance with claim 21 wherein said metal containers comprise steel drums.

25. A method in accordance with claim 21 wherein said combustion chamber is a rotary kiln.

26. A method in accordance with claim 25 wherein said rotary kiln is rotated about a horizontally declined axis of rotation.

27. A method in accordance with claim 21 wherein said step of transporting the mixture of waste material and metal shreds into said primary combustion chamber further comprises: using a hopper and a compaction tube for transporting the mixture of waste material and metal shreds from said hopper to said primary combustion chamber.

28. A method in accordance with claim 27 wherein said step of transporting the mixture from said hopper to said primary combustion chamber further comprises using an auger.

29. A method in accordance with claim 28 wherein said auger is positioned within said compaction tube in a manner such that said mixture contacts the inner walls of said compaction tube while being transported to the combustion chamber, thereby forming a seal along at least a portion of said compaction tube.

30. A method in accordance with claim 29 further comprising the steps of withdrawing hot secondary combustion gases from said secondary combustion chamber and feeding the hot secondary combustion gases into a quench tower, wherein hot secondary combustion gases are contacted with water to produce saturated gases and effluent water.

31. A method in accordance with claim 30 further comprising the steps of:

transporting saturated gases from said quench tower to a scrubber;

intimately contacting saturated gases with water in said scrubber to remove the entrained ash and particulates from the saturated gases, thereby producing effluent water and saturated gases; and, transporting effluent water and saturated gases from said scrubber to a separator, wherein the effluent water is separated from the saturated gases.

32. A method in accordance with claim 31 wherein said scrubber comprises a venturi scrubber.

33. A method in accordance with claim 31 wherein said separator comprises a separator tower.

34. A method in accordance with claim 31 further comprising the step of withdrawing water from said separator and said quench tower and feeding the water to an affluent water reservoir.

35. A method in accordance with claim 31 wherein the water supplied to said quench tower and said scrubber are withdrawn from said an effluent water reservoir.

36. A method in accordance with claim 31 further comprising the steps of:

transporting saturated gases from said separator, through an induced draft fan, into an acid absorber column, wherein said saturated gases are countercurrently contacted with caustic and water to remove all remaining acid from the saturated gases, thereby producing deacidified gases;

contacting the deacidified gases with a gas analyzer; and, passing said deacidified gases from said acid absorber column to the atmosphere.

37. A method in accordance with claim 21 further comprising the steps of:

withdrawing said ash and said decontaminated metal shreds from said combustion chamber;

withdrawing said combustion gases from said combustion chamber and feeding saId combustion gases into a second combustion chamber wherein any combustible materials remaining in said combustion gases arc combusted, thereby producing hot gases containing entrained ash and particulates;

withdrawing said hot gases from said second combustion chamber and feeding said ho( gases into a quench tower, wherein said hot gases are contacted with water to produce saturated gases and effluent water;

transporting said saturated gases from said quench tower to a scrubber, wherein said saturated gases are intimately contacted with water to remove the entrained ash and particulates from said saturated gases, thereby producing effluent water and saturated gasses;

transporting said effluent water and said saturated gases from said scrubber to a separator, wherein said effluent water is seperated from said saturated gases;

transporting said saturated gases from said separator, through an induced draft fan, into an acid absorber column, wherein said saturated gases are countercurrently contacted with caustic and water to remove all remaining acid from the saturated gases, thereby producing deacidified gases;

withdrawing effluent water from said separator and said quench tower and feeding said effluent water to a recycle water reservoir;

withdrawing water from said recycle water reservoir and feeding said water to said quench tower and said scrubber;

contacting the deacidified gases with a gas analyzer; and, passing said deacidified gases from said acid absorber column to the atmosphere.

38. A method in accordance with claim 37 wherein said scrubber comprises a venturi scrubber.

39. A method in accordance with claim 37 wherein said separator comprises a separator tower.

40. An apparatus for the disposal of waste material contained within a metal container comprising:

a shredder, capable of shredding a metal container into metal shreds, wherein said waste material and said metal container are shredded to form a mixture of waste material and metal shreds;

means for introducing said metal container containing said waste material into said shredder;

a combustion chamber, wherein said mixture of waste material and metal shreds is combusted, thereby producing ash decontaminated metal shreds and combustion gases;

means for feeding said mixture of waste material and metal shreds from said shredder into said combustion chamber;

means for introducing air into said combustion chamber;

burner means for igniting the contents within said combustion chamber;

means for supplying air and auxiliary fuel to said burner means;

means for withdrawing said ash and said decontaminated metal shreds from said combustion chamber;

a secondary combustion chamber, wherein any combustible materials remaining in said combustion gases are combusted, thereby producing hot gases containing entrained ash and particulates;

first conduit means in fluid flow communication between said combustion chamber and said secondary combustion chamber, for defining a flow path for said combustion gases from said combustion chamber to said secondary combustion chamber;

quenching means for contacting said hot gases with water, thereby producing saturated gases and effluent water;

second conduit means in fluid flow communication between said secondary combustion chamber and said quenching means, for defining a flow path for said hot gases from said secondary combustion chamber to said quench tower;

scrubber means for removing said ash and particulates from said saturated gases, thereby producing effluent water containing ash and particulates and saturated gasses;

third conduit means in fluid flow communication between said quench tower and said scrubber means, for defining a flow path for said saturated gases from said quench tower to said scrubbing means;

separator means for separating said saturated gases from said effluent water containing ash and particulates;

fourth conduit means in fluid flow communication between said scrubber means and said separator means, for defining a flow path for said effluent water containing ash and particulates and said saturated gases from said scrubber means to said separator means;

a recycle water reservoir;

fifth conduit means in fluid flow communication between said separator means and said quench tower and said recycle water reservoir, for defining a flow path for the effluent water from said separator means and said quench tower to said recycle water reservoir;

means for introducing fresh water to said recycle water reservoir; and, sixth conduit means in fluid flow communication between said recycle water reservoir and said quench tower and said scrubber means, for defining a flow path for recycle water from said recycle water reservoir to said quench tower and said scrubber means.

an acid absorber column, said column having a stack which is open on one end to the atmosphere such that deacidified gas may pass from the column, throught the stack, into the atmosphere;

means for introducing water and caustic to said acid absorber column;

an induced draft fan, wherein said induced draft fan is located between said scrubber means and said acid absorber tower;

seventh conduit means in fluid flow communication between said separator means and said induced draft fan and between said induced draft fan and said acid absorber column, for defining a flow path for said saturated gases from said separator means, through said induced draft fan, into said acid absorber column;

a gas analyzer; and, eighth conduit means in fluid flow communication between said gas analyzer and said absorber column, for defining a flow path for a portion of said deacidified gas from said acid absorber column to said gas analyzer.

41. A method for disposing of waste material contained within a metal container comprising the steps of:

feeding said metal container containing said waste material into a shredder, wherein said waste material and said metal container are shredded to form a mixture of waste material and metal shreds;

transporting said mixture of waste material and metal shreds to a combustion chamber, wherein said mixture is combusted, thereby producing ash, decontaminated metal shreds, and combustion gases;

introducing a sufficient amount of air into said combustion chamber to insure the complete combustion of said mixture;

withdrawing said ash and said decontaminated metal shreds from said combustion chamber;

withdrawing said combustion gases from said combustion chamber and feeding said combustion gases into a second combustion chamber wherein any combustible materials remaining in said combustion gases are combusted, thereby producing hot gases containing entrained ash and particulates;

withdrawing said hot gases from said second combustion chamber and feeding said hot gases into a quench tower, wherein said hot gases are contacted with water to produce saturated gases and effluent water;

transporting said saturated gases from said quench tower to a scrubber, wherein said saturated gases are intimately contacted with water to remove the entrained ash and particulates from said saturated gases, thereby producing effluent water and saturated gasses;

transporting said effluent water and said saturated gases from said scrubber to a separator, wherein said effluent water is seperated from said saturated gases;

transporting said saturated gases from said separator, through an induced draft fan, into an acid absorber column, wherein said saturated gases are countercurrently contacted with caustic and water to remove all remaining acid from the saturated gases, thereby producing deacidified gases;

withdrawing effluent water from said separator and said quench tower and feeding said effluent water to a recycle water reservoir;

withdrawing water from said recycle water reservoir and feeding said water to said quench tower and said scrubber;

contacting the deacidified gases with a gas analyzer; and, passing said deacidified gases from said acid absorber column to the atmosphere.

42. Apparatus in accordance with claim 1, wherein the physically distinct phase of the waste material kept in the metal container is selected from the group of phases comprising solid, liquid, and gas.

43. Apparatus in accordance with claim 1, wherein the waste material kept in the metal container is a sludge.

44. Apparatus in accordance with claim 1 wherein the waste material kept in the metal container is a slurry.

45. Apparatus in accordance with claim 1, wherein the waste material kept in the metal container is a hazardous material.

46. A method in accordance with claim 21, wherein the physically distinct phase of the waste material kept in the metal container is selected from the group of phases comprising solid, liquid, and gas.

47. A method in accordance with claim 21, wherein the waste material kept in the metal container is a sludge.

48. A method in accordance with claim 21, wherein the waste material kept in the metal container is a slurry.

49. A method in accordance with claim 21, wherein the waste material kept in the metal containers is a hazardous material.

* * * * *